US007598885B2

(12) United States Patent
Kwon et al.

(10) Patent No.: US 7,598,885 B2
(45) **Date of Patent: *Oct. 6, 2009**

(54) CONTROL PANEL OF A LAUNDRY PROCESSING MACHINE

(75) Inventors: Dae Hee Kwon, Busan-si (KR); Hyun Seok Kim, Seoul (KR); Bo Yeon Kim, Changwon-si (KR); Hye Yong Park, Changwon-si (KR); Seong Yeol Lee, Daegu-si (KR)

(73) Assignee: LG Electronics, Inc., Seoul (KR)

( * ) Notice: Subject to any disclaimer, the term of this patent is extended or adjusted under 35 U.S.C. 154(b) by 319 days.

This patent is subject to a terminal disclaimer.

(21) Appl. No.: 11/437,865

(22) Filed: May 22, 2006

(65) Prior Publication Data

US 2007/0119484 A1 May 31, 2007

(30) Foreign Application Priority Data

May 23, 2005 (KR) ..... 10-2005-0043199

(51) Int. Cl.
*G09F 13/04* (2006.01)

(52) U.S. Cl. ..... 340/815.45; 340/815.47; 340/815.55; 362/27; 200/296

(58) Field of Classification Search ..... 340/815.45, 340/815.47, 815.55; 200/296, 316, 19.18; 362/26, 27

See application file for complete search history.

(56) References Cited

U.S. PATENT DOCUMENTS

| | | | | |
|---|---|---|---|---|
| 3,911,430 | A * | 10/1975 | Jankowski et al. | 340/815.42 |
| 5,504,660 | A * | 4/1996 | Heidorn | 362/27 |
| 6,685,327 | B2 * | 2/2004 | Dorrie | 362/27 |
| 6,964,489 | B2 * | 11/2005 | Blume et al. | 362/27 |
| 7,091,434 | B2 * | 8/2006 | Suzuki | 200/316 |
| 7,180,023 | B2 * | 2/2007 | Seo | 200/329 |
| 7,222,979 | B1 * | 5/2007 | Popowich et al. | 362/26 |
| 7,394,033 | B2 * | 7/2008 | Kim | 200/296 |
| 2006/0164397 | A1 * | 7/2006 | Bruntz et al. | 345/172 |

* cited by examiner

*Primary Examiner*—Davetta W Goins
*Assistant Examiner*—Anne V Lai
(74) *Attorney, Agent, or Firm*—McKenna Long & Aldridge LLP

(57) ABSTRACT

A control panel of a laundry processing machine includes a control substrate having LEDs, a transparent window having transparent protrusions formed to be corresponded to the LEDs, and a display cover having a plurality of ribs which are protruded at a surface of the display cover and placed between the transparent protrusions, thereby one of lights emitted from the LEDs is directed to the corresponding transparent protrusions without being spread elsewhere.

13 Claims, 5 Drawing Sheets

CONTROL PANEL OF A LAUNDRY PROCESSING MACHINE

This application claims the benefit of Korean Patent Application No. 2005-43199, filed on May 23, 2005, which is hereby incorporated by reference for all purposes as if fully set forth herein.

BACKGROUND OF THE INVENTION

1. Field of the Invention

The present invention relates to the control panel of a laundry processing machine, and more particularly, to the control panel of a laundry processing machine making the light emitted from plural LEDs only direct to transparent protrusions by protrudingly forming a rib in between plural transparent protrusions.

2. Description of the Conventional Art

In general, a laundry processing machine refers to a washing machine which uses water, detergent and mechanical movement to clean stains from clothes or bedding (Referred as 'fabric' afterwards), a dryer which uses warm dry wind created by a heater to dry wet fabric and a washer dryer which combines washing and drying in one machine.

FIG. 1 shows a perspective view of a laundry processing machine according to the conventional arts. FIG. 2 shows the side cross-section view of a laundry processing machine according to the conventional arts. FIG. 3 is the cross section view of the control panel of a laundry processing machine according to the conventional arts As shown in FIG. 1 to FIG. 3, a laundry processing machine which uses conventional arts includes a cabinet(2) forming an exterior of the laundry processing machine, a tub(10) disposed in the cabinet(2) filled with the water used, a drum(12) disposed in the tub(10) holding the laundry, a motor(14) rotating the drum(12), a water supply (16) unit that provides water, and a drain(18) unit that pumps out the used water.

An entrance hole(4) is disposed on the front of the cabinet (2) to allow laundry to be entered into the drum(12) and a door is installed to seal the entrance hole(4).

A control panel(30) is disposed on the upper frontal part of the cabinet(2) to show the current movement of the machine and control the movement of a laundry processing.

As shown in FIG. 3 a control panel(30) of a laundry processing machine is comprised of a control substrate(36) which holds all sorts of electronic parts such as a rotary switch(32), and LED (Light Emission Diode, 34),a rotary knob(45) linked to the rotary switch(32) and a rotating shaft (33) and is used by the user, a LED supporter(46) directing to the light emitted by the LED(34) and linked to the control substrate(36), and a control panel(38) that covers the entire frontal part of the control substrate(36)

Also, the control panel(30) of a laundry processing machine comprises the deco(44) which disposes in the opening hole(40) of the control panel(30) and a transparent window in the back of the deco(44).

Within the transparent window(48), the plural LEDs(34) emit light and therefore transparent protrusions(47) are placed to correspond to the plural LEDs(34), the transparent protrusions(47) within the deco(44) need plural penetrating holes(49) for it to go through and they are placed.

On the back of the transparent window(48), a separate sheet was stuck or an opaque substance was printed so that the light emitted by the LED(34) is not spread other than the transparent protrusions(47).

However, a laundry processing machine according to conventional arts has problems such as spreading the light from the LEDs(34) due to poor printing, and the process of printing on the transparent window(48) with an opaque substance in itself was complicate.

Also, sticking a separate sheet to the transparent window (48) had its problems as the sheet fell off, so that it allow the light emitted from the LEDs(34) to spread.

SUMMARY OF THE INVENTION

The present invention originated to solve the mentioned problems and its purpose is to provide a control panel of a laundry processing machine to prevent light spreading from the LED.

To achieve the mentioned purpose of the invention, the control panel of a laundry processing machine is composed of a control substrate with plural LEDs in the front and a transparent window which had plural transparent protrusions to the LED lights in the front of control substrate, and between the transparent protrusions, one of the lights emitted from plural LEDs is only directed to corresponding to the transparent protrusions, therefore, preventing light from spreading.

The light spread preventing means is the ribs formed protrudingly between the plural transparent protrusions.

The control panel of a laundry processing machine is disposed on the front of the transparent window and further included display cover which allows the plural transparent protrusions to penetrate.

The light spread preventing means is the ribs formed protrudingly in between the plural transparent protrusions in the display covers.

A rotary switch is placed on the control substrate and plural LEDs are placed around the rotary switch according to the circular direction as predetermined interval.

The transparent window follows the arc shape of the rotary switch and the platebody. The plural transparent protrusions are in at least one side of the interior or exterior of the platebody but always has its protrusion in back and forth directions.

The transparent window is characterized by forming the rib insert holes, for inserting the ribs in between the plural transparent protrusions.

The control panel of a laundry processing machine is further including a control substrate and their LED supporters supports the plural LEDs mounted in a control substrate.

The light spread preventing means is characterized by forming the ribs protruding in between the plural transparent protrusions within the LED supporter.

The transparent window has the rib insert holes made, for the ribs between the plural transparent protrusions.

As mentioned in detail above, in the invention of the control panel of a laundry processing machine, light spread preventing means occurs in between the plural transparent protrusions and as one of the lights emitted by LEDs is only directed to counteracting transparent protrusions, LED light will not be spread elsewhere and therefore it is possible to increase user recognition.

Also, the light spread preventing means is easier in production by forming protrudingly from the display cover and LED supporter.

Additionally, the process of printing an opaque substance or sticking a separate sheet on the transparent window is extracted, hence making the production process cheaper and easier than before.

Figure 1:
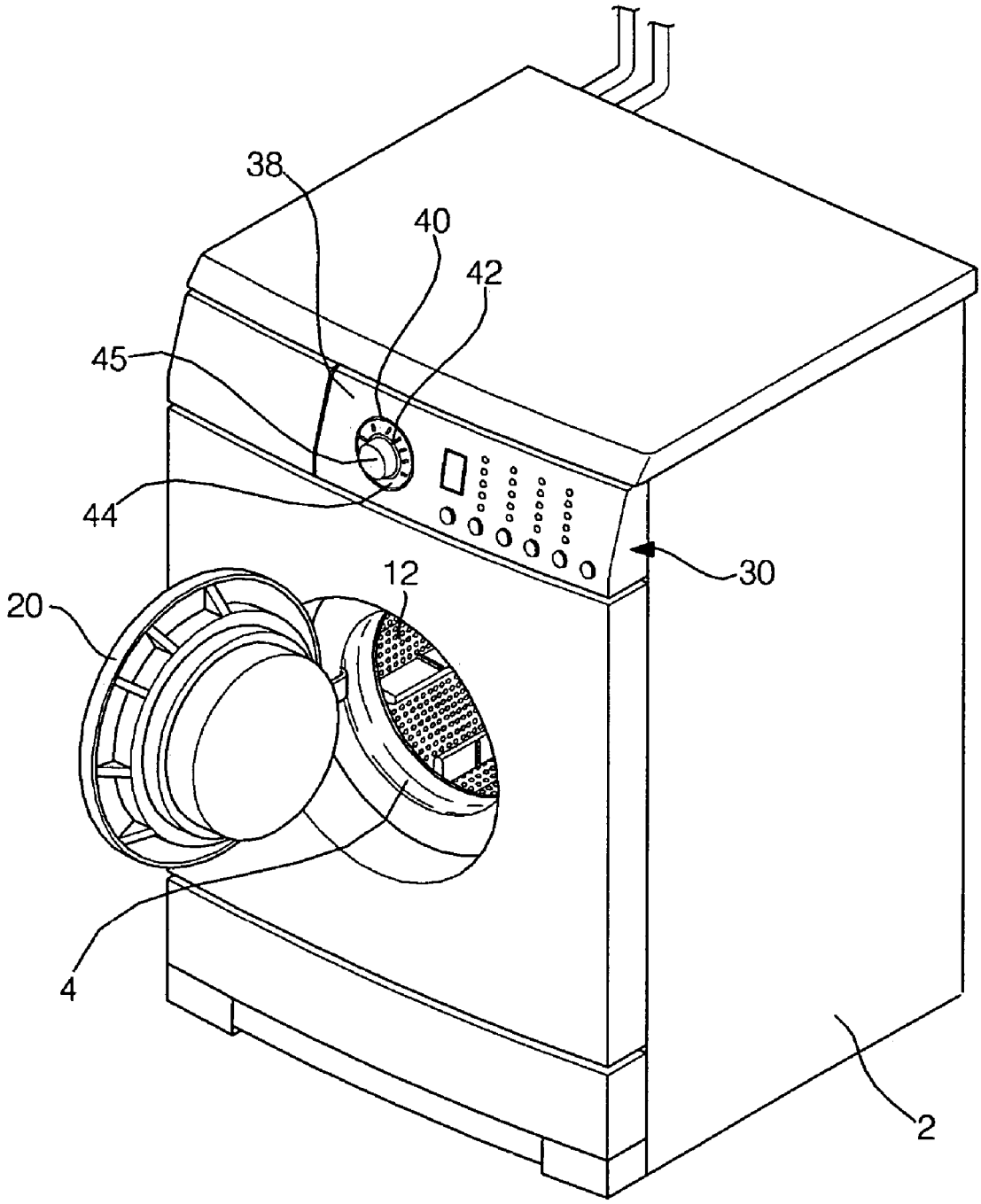
FIG. 1 (related art)
FIG. 1 shows the perspective view of the control panel of a laundry processing machine according to the conventional arts.
Figure 2:
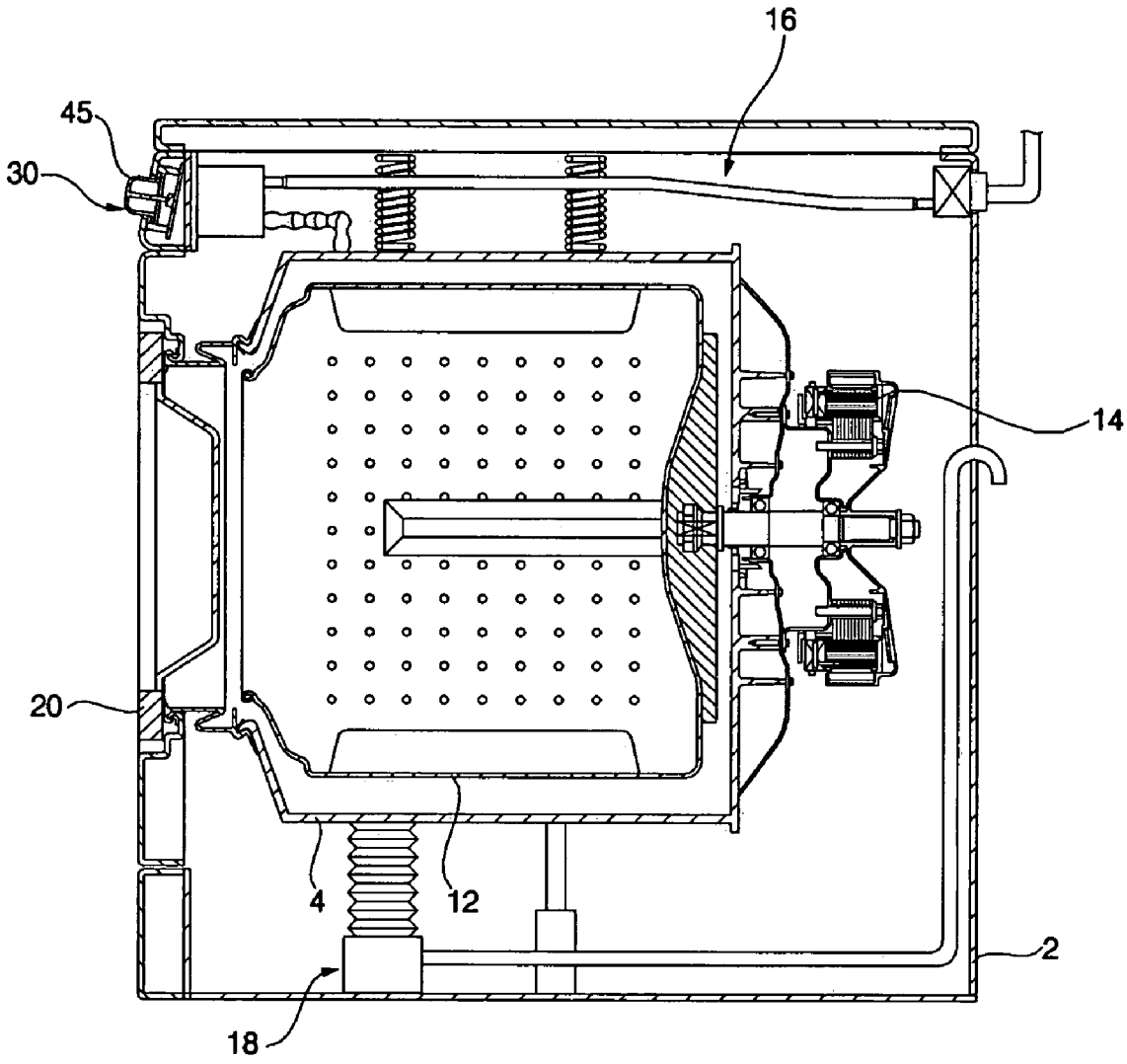
FIG. 2 (related art)
FIG. 2 shows the side cross-section of the control panel of a laundry processing machine according to the conventional arts.
Figure 3:
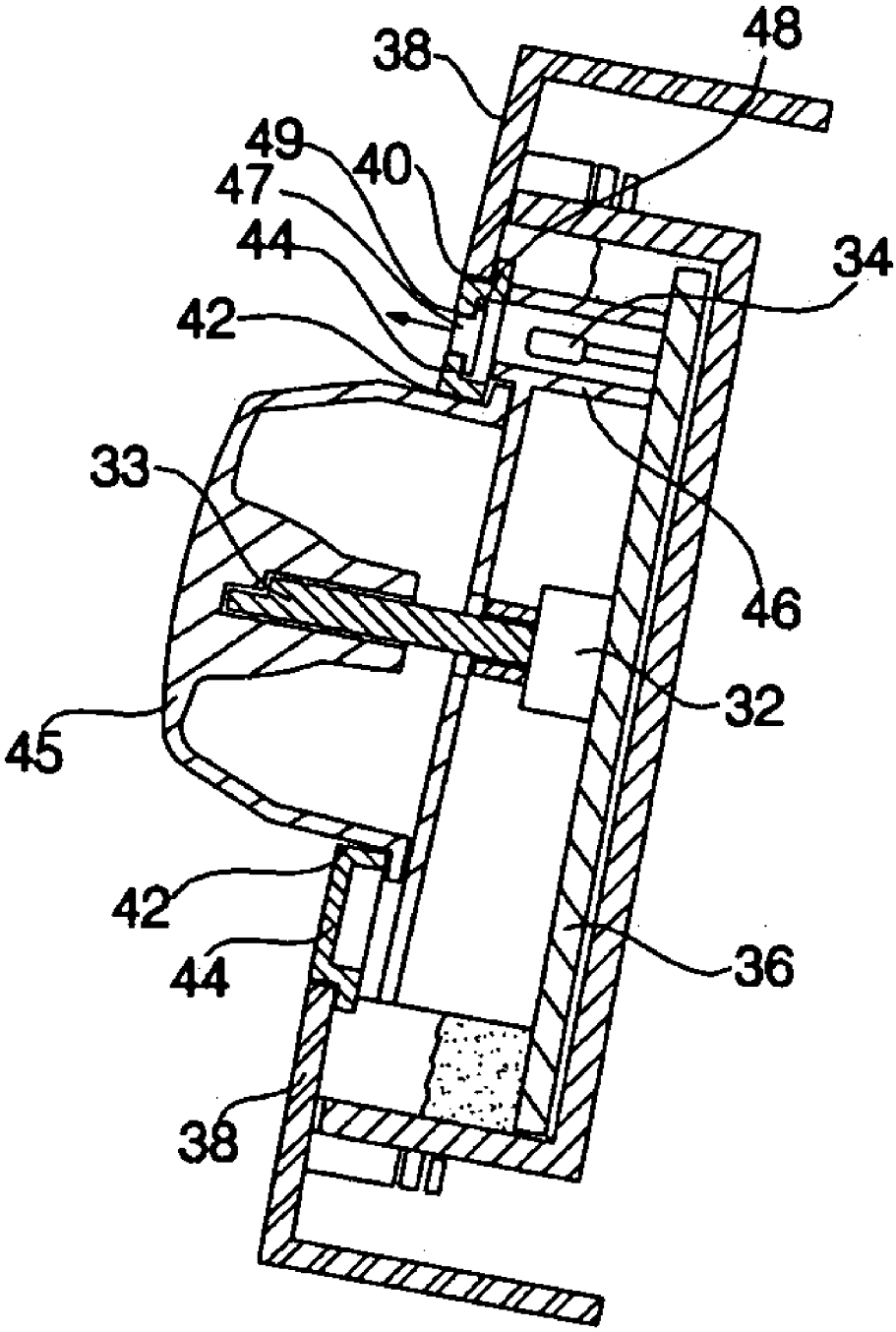
FIG. 3 (related art)
FIG. 3 shows the vertical-sectional diagram of the control panel of a laundry processing machine according to the conventional arts.

<Brief description of the signatures in the drawings>

50: The control panel of a laundry processing machine.
52: Rotary switch
54: LED
56: control substrate
58, 100: LED supporter protrusions
60, 114: Transparent
61, 112: platebody
62, 110: transparent window
70: The light spread preventing means
72: display cover
74: Light display hole
76: Knob Penetrating Hole
78: Control Panel
79: Penetrating Hole
80: Rotary knob
82: Shaft
85: Shaft Penetrating Hole
87, 104: cell section
102: Rib
116: Rib insert hole

DETAILED DESCRIPTION OF THE PREFERRED EMBODIMENT

Hereafter, by looking at the attached figures, we may explain the examples of the control panel of a laundry processing machine according to the invention.

The control panel of a laundry processing machine according to this invention may have several embodiments, hereafter; only the most: appropriate embodiment will be explained.

Figure 4:
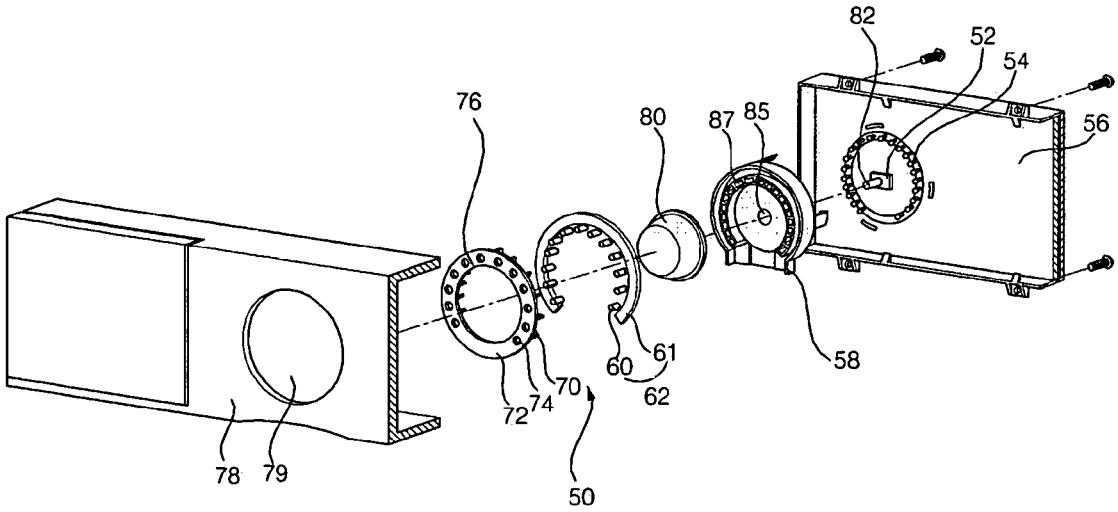
FIG. 4 shows the disassembled perspective view of the control panel of a laundry processing machine according to the first embodiment of the invention.
Figure 5:
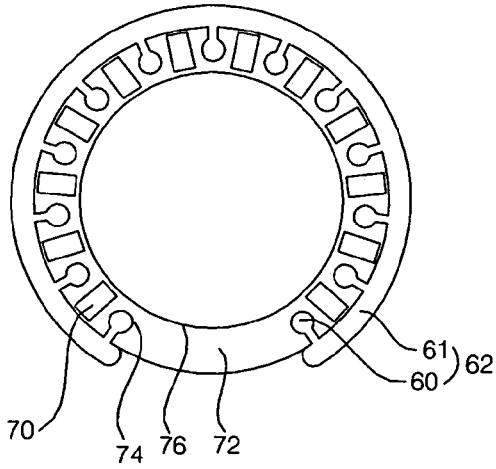
FIG. 5 shows the rear view of the window in the deco of the control panel of a laundry processing machine according to the first embodiment of the invention.

FIG. 4 shows the disassembled perspective view of the control panel of a laundry processing machine according to the first embodiment of the invention. FIG. 5 shows the rear view of display cover with transparent window according to the first embodiment of the invention.

As shown in FIG. 4 and 5, the control panel(50) of a laundry processing machine comprises of a control substrate (56) which holds all sorts of electronic parts such as a rotary switch(52), and the plural LEDs(54); a transparent window (62) which has the transparent protrusions(60) corresponded to the plural LEDs(54) and placed in the front of control substrate; the light spread preventing means(70) where LED (54) light only faces the corresponding transparent protrusions(60).

The control panel of a laundry processing machine(50) is further comprised of a display cover(72) that allows the plural transparent protrusions to penetrate the frontal part of the transparent window(62); a control panel(78) to create an exterior to cover the control substrate(56).

In the display cover(72), a light display hole(74) corresponded to each plural LEDs(54); a knob penetrating hole (76) which the rotary knob(80) combined with the rotary switch(52) that can penetrate in the center are formed.

In the control panel(78), penetrating Hole(79) are formed to counteract the knob penetrating hole(76) so that the rotary knob(80) can be externally exposed.

In the rotary switch(52), a rotating shaft(82) is formed protrudingly so that it could be connected to the rotary knob (80) and internally, a switching circuit is mounted to allow the rotation of the shaft(82)

The plural LEDs are placed around the rotary switch according to the circular direction as predetermined intervals.

Also, on the control substrate(56), LED supporters which support the plural LEDs, are mounted.

On the LED supporter, a shift penetrating hole which penetrates the rotating shaft(82) of the rotary knob(80) is formed and several cell sections which surrounds each LED is also formed.

The plural cell sections are made by protruding the plural walls to surround the plural LEDs.

The transparent window(62) has the platebody(61) formed according to the around the rotary switch(52), the plural transparent protrusions are in at least one side of the interior or exterior of the platebody but always has its protrusion in back and forth directions.

In this specification, we will explain only an internal extrusion, back and forth, of the plural transparent protrusions(60) in the platebody(61)

The diameter of the platebody(61) is formed greater than the diameter of the display cover.

The transparent window is made up of transparent material so that light emitted from the LED can be transmitted.

The light spread preventing means(70) is the rib protruding in between the plural transparent protrusions(60) on the rear side of the display cover(72).

The rib is made up of an opaque material that does not allow the light from the LED(54) to penetrate, and is made integrally when the display cover are injection molded.

Hereafter, the following refers to the movement of the control panel of a laundry processing machine.

First, when the user turns the rotary knob(80) clockwise or counter clockwise, the shaft(82) in the rotary switch(52) rotates with the rotary knob(80) and this changes the movement of the switching circuit. Due to this change in the switching circuit, a laundry processing machine controls the washing, rinsing or tumble drying depending on the option chosen.

When the option is chosen in a laundry processing machine, one of plural LEDs(54) will emit light.

The light emitted by LED will transmit the plural transparent protrusions corresponding to the LED and with the rotation of the rotary knob, will externally show the selected option.

The rib(70) formed on the rear of the display cover(72) blocks in between the plural transparent protrusions(60) therefore the LED(54) light does not spread, except the transparent protrusions(60) which placed in corresponding locations of back and forth directions.

Therefore, external spreading of light will be prevented hence increasing user recognition, and as there is no need to attach a separate sheet or print on the back of the transparent window(62), production process becomes simpler and there is a lower risk of faulty products.

Figure 6:
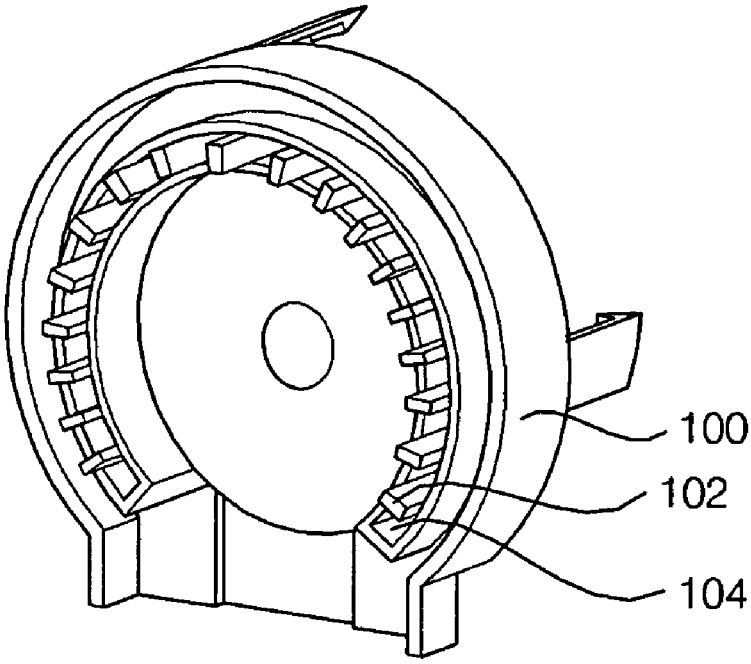
FIG. 6 shows the perspective view of an enlarged version of the LED supporter of the control panel of a laundry processing machine according to the second embodiment of the invention.

FIG. 6 on one hand shows the perspective view of an enlarged version of the LED supporter of the control panel of a laundry processing machine according to the second embodiment of the invention.

Because the second embodiment has many similarities with the first embodiment, the same numbers will be used to explain.

According to example 2 of the invention, on the control panel(50) of a laundry processing machine, several ribs(102) as a light spread preventing means are protruding on the front part of the LED supporter(100).

The LED supporter(100) makes the cell section to form a wall for the plural LEDs(54) and an extension of this is the plural ribs(102) created by the wall between the transparent protrusions(60).

Figure 7:
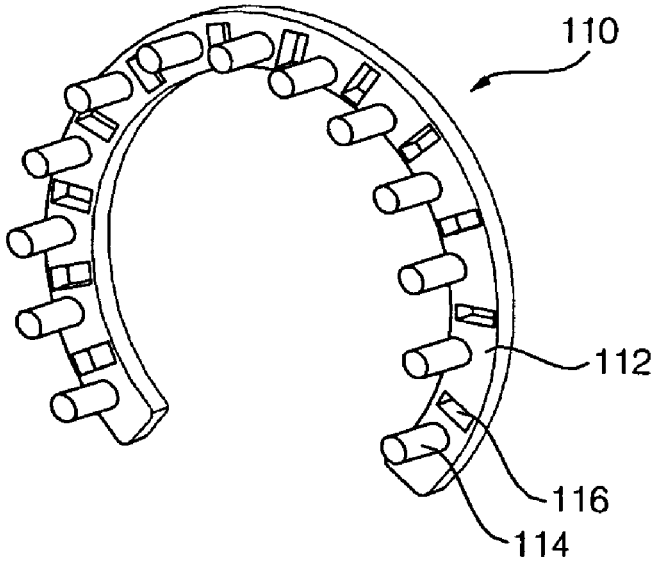
FIG. 7 shows the perspective view of the window of the control panel of a laundry processing machine according to the third embodiment of the invention.

FIG. 7 on the other hand shows the perspective view of the window.

Because the third embodiment has many similarities with the first embodiment, the same numbers will be used to explain.

In regard to the current invention, the transparent window is made up of the platebody (112) formed by the circular effect, and the frontal part of the platebody(112) is placed with plural transparent protrusions(114) to correspond the plural LEDs(54), while making a rib insert hole(116) on the platebody(112) so that the protruding rib from the LED supporter or display cover can be inserted.

Therefore, even if the plural transparent protrusions(114) are made on the front of the platebody(112), the ribs are located in between the plural transparent protrusions hence preventing light from spreading.

In accordance with the purpose of the current invention the advantages of the control panel of a laundry processing machine are as follows.

As mentioned in detail above, in the invention of the control panel of a laundry processing machine, light spread preventing means occurs in between the plural transparent protrusions and as one of the lights is emitted by the plural LEDs is only directed to corresponding transparent protrusions, LED light will not be spread elsewhere and therefore it is possible to increase user recognition.

Also, the light spread preventing means is easier in production because the protrusion occurs in the display cover or in the LED supporter.

Also, the process of printing an opaque substance or sticking a separate sheet on the transparent window is extracted, hence making the production cheaper and easier than before.

What is claimed is:

1. A control panel of a laundry processing machine comprising:

a control substrate provided with a plurality of LEDs;

a transparent window provided with a plurality of transparent protrusions formed to correspond to the LEDs; and a light spread preventing means placed between the transparent protrusions such that the light emitted from each of the plurality of the LEDs is directed to each LED's corresponding transparent protrusion, wherein the control panel further comprises a display cover in which the transparent protrusions are inserted, wherein the light spread preventing means is a plurality of ribs protruding at a surface of the display cover.

2. The control panel of the laundry processing machine of claim 1, wherein the control panel further comprises a rotary switch placed on the control substrate and the plurality of LEDs are mounted to surround the rotary switch according to a circular direction at predetermined intervals.

3. The control panel of the laundry processing machine of claim 1, wherein the transparent window includes a platebody which is formed to follow an arc shape of a rotary switch, and the plurality of transparent protrusions are positioned on at least one side of an interior or exterior of the platebody.

4. The control panel of the laundry processing machine of claim 3, wherein the transparent window has a plurality of rib insert holes in which the ribs are inserted.

5. The control panel of the laundry processing machine of claim 1, wherein the control panel further comprises a plurality of LED supporters, which support the plurality of LEDs provided to the control substrate.

6. The control panel of the laundry processing machine of claim 5, wherein the ribs protrude between the plurality of transparent protrusions from the LED supporters.

7. The control panel of the laundry processing machine of claim 6, wherein the transparent window has a plurality of rib insert holes in which the ribs are inserted.

8. The control panel of the laundry processing machine of claim 5, wherein the LED supporters protrude to form a plurality of walls to surround each individual LED.

9. The control panel of the laundry processing machine of claim 8, wherein the walls are formed to extend between the transparent protrusions.

10. The control panel of the laundry processing machine of claim 1, wherein the control panel covers the control substrate.

11. A control panel of a laundry processing machine comprising:

a control substrate provided with a plurality of LEDs;

a transparent window provided with a plurality of transparent protrusions formed to correspond to the LEDs;

a display cover at which a plurality of light display holes are formed to correspond to each of the LEDs; and a light spread preventing means placed between the plurality of light display holes such that light emitted from a given LEDs is directed to that given LED's light display hole, wherein the light spread preventing means is a plurality of ribs protruding toward the transparent window on a back side of the display cover.

12. The control panel of the laundry processing machine of claim 11, wherein a plurality of rib insert holes are formed in the transparent window to receive corresponding ones of the plurality of ribs.

13. The control panel of the laundry processing machine of claim 11, wherein the control panel covers the control substrate.

* * * * *